US006446878B1

(12) United States Patent
Chandra et al.

(10) Patent No.: US 6,446,878 B1
(45) Date of Patent: Sep. 10, 2002

(54) APPARATUS AND METHOD FOR GENERATING DROPLETS

(75) Inventors: Sanjeev Chandra, 34 Neuchatel Place, Mississauga, Ontario (CA), L5N 6A7; Rahim Jivraj, 75 Thorncliffe Park Dr. Apt. 519, Toronto, Ontario (CA), M4H 1L4

(73) Assignees: Sanjeev Chandra, Mississauga (CA); Rahim Jivraj, Toronto (CA)

( * ) Notice: Subject to any disclaimer, the term of this patent is extended or adjusted under 35 U.S.C. 154(b) by 0 days.

(21) Appl. No.: 09/516,183

(22) Filed: Mar. 1, 2000

Related U.S. Application Data

(60) Provisional application No. 60/122,271, filed on Mar. 1, 1999.

(51) Int. Cl.[7] ..... B05B 17/00; B05B 1/08

(52) U.S. Cl. ..... 239/1; 239/13; 239/70; 239/99; 239/101; 239/135; 239/347; 239/373; 222/420

(58) Field of Search ..... 239/13, 83, 70, 239/75, 1, 119, 135, 548, 347, 373, 566, 690, 348, 533.15, 533.1, 99, 101, 128, 104, 120, 126; 73/864.81, 864.83, 864.84, 863.01; 222/325, 394, 397, 399, 401, 420

(56) References Cited

U.S. PATENT DOCUMENTS

| | | | | |
|---|---|---|---|---|
| 3,499,580 A | | 3/1970 | Smith | |
| 3,679,132 A | * | 7/1972 | Vehe et al. | 239/102.2 X |
| 4,030,640 A | * | 6/1977 | Citrin et al. | 222/420 X |
| 4,041,995 A | | 8/1977 | Columbus | |
| 4,142,656 A | * | 3/1979 | Smith et al. | 222/420 X |
| 4,613,076 A | | 9/1986 | Dietz et al. | |
| 4,675,301 A | * | 6/1987 | Charneski et al. | 222/396 X |
| 4,744,821 A | | 5/1988 | Yabuki et al. | |
| 4,828,886 A | | 5/1989 | Hieber | |
| 4,919,335 A | | 4/1990 | Hobson et al. | |
| 5,171,360 A | | 12/1992 | Orme et al. | |
| 5,229,016 A | | 7/1993 | Hayes et al. | |
| 5,257,657 A | | 11/1993 | Gore | |
| 5,266,098 A | | 11/1993 | Chun et al. | |
| 5,340,090 A | | 8/1994 | Orme et al. | |
| 5,445,666 A | | 8/1995 | Peschka et al. | |
| 5,465,629 A | * | 11/1995 | Waylett, Jr. | 73/864.24 |
| 5,529,809 A | | 6/1996 | Glovan et al. | |

(List continued on next page.)

OTHER PUBLICATIONS

Patent Abstracts of Japan, vol. 1998, No. 01, Jan. 30, 1998. & JP 09 225374 A (NEC Kyushu Ltd; Emiile Denshi Kaihatsushiy:KK), Sep. 2, 1997.

DE 31 33 944 A (Sulzer Ag) Mar. 3, 1883 *abstract*.

*Primary Examiner*—Steven J. Ganey
(74) *Attorney, Agent, or Firm*—Lynn C. Schumacher; Hill & Schumacher

(57) ABSTRACT

An apparatus and method for the production of small, uniform sized droplets. The apparatus is a droplet generator including a housing defining a chamber for holding a material to be ejected therefrom, an inlet and a droplet outlet communicating with the chamber. The housing is coupled to a pressurizing system connected to the inlet for applying pressure pulses to the chamber. The housing includes a vent in communication with the chamber for relieving pressure in the chamber. The vent has an effective size so that during application of the pressure pulse the chamber is pressurized to a pressure effective to eject a droplet of the material therefrom and thereafter the chamber is vented through the vent at a rate sufficient to prevent further discharge of droplets. The droplet generator produces molten metal or alloy droplets and is particularly suitable for generating single droplets on demand in manufacturing techniques using droplet deposition. It is also useful for production of spherical microspheres and uniform sized powders, and dispensing of precise quantities of materials such as adhesives and pharmaceuticals.

23 Claims, 10 Drawing Sheets

U.S. PATENT DOCUMENTS 5,560,543 A 10/1996 Smith et al.
5,598,200 A 1/1997 Gore
5,609,919 A 3/1997 Yuan et al.
5,722,479 A 3/1998 Oeftering
5,746,844 A 5/1998 Sterett et al.
5,749,408 A 5/1998 Gore
5,810,988 A 9/1998 Smith, Jr. et al.
6,152,383 A * 11/2000 Chen ..... 239/102.2

* cited by examiner

APPARATUS AND METHOD FOR GENERATING DROPLETS

CROSS REFERENCE TO RELATED U.S. APPLICATION

This application relates to United States Provisional patent application, Ser. No. 60/122,271, filed on Mar. 1, 1999, entitled APPARATUS AND METHOD FOR GENERATING UNIFORM SIZED DROPLETS.

FIELD OF THE INVENTION

The present invention relates to a method and apparatus for the production of droplets of liquid at high temperatures, such as a molten metal or alloy, and more particularly the present invention relates to a method and apparatus for controlled generating of droplets on demand in manufacturing processes.

BACKGROUND OF THE INVENTION

Free standing metal objects can be manufactured by the deposition of individual droplets of molten metal, using a computer to manipulate the droplet generator and the substrate, as described in U.S. Pat. No. 5,340,090 to Orme et al. and U.S. Pat. No. 5,746,844 to Sterett. Droplet deposition has also been used in U.S. Pat. No. 5,229,016 to Hayes et al. to dispense small amounts of solder at precisely determined locations on a circuit board prior to attaching an integrated circuit chip to it. Such manufacturing techniques require the ability to generate, on demand, small droplets of a molten metal. Consequently several designs for such droplet generators have been developed. Typically such generators consist of a heated chamber filled with molten metal. A droplet is formed by applying a pressure pulse to the pool of metal, ejecting a small quantity of liquid through a nozzle. Several different techniques have been used to apply this pressure pulse, including piezoelectric crystals, mechanical plungers, acoustic waves, and magneto-hydrodynamic (MHD) forces discussed herebelow.

Piezoelectric droplet generators are widely used for ink-jet printing. They have a chamber containing liquid, one wall of which is made from piezoelectric material. Applying a voltage pulse to the piezo-electric crystal makes it flex, sending a pressure pulse through the liquid in contact with it and forcing out a droplet. In U.S. Pat. No. 4,828,886 to Hieber, liquid solder is supplied through a glass tube around which an annular piezoelectric transducer is mounted. Application of a voltage to the transducer makes it contract and compress the glass tube, emitting solder from the tube. Use of such transducers is restricted to low melting point metals, because they lose their responsive properties above the Curie temperature (about 350° C. for most piezoelectric materials).

Mechanical systems of levers and plungers have been used to form droplets of high temperature metals. Chun et al. (U.S. Pat. No. 5,266,098) and Yuan et al. (U.S. Pat. No. 5,609,919) used a reciprocating plunger to periodically apply impulses to a liquid metal and force it through an array of holes in the bottom of the container. In U.S. Pat. No. 5,598,200 to Gore single droplets are ejected on demand by positioning a plunger over an orifice in a chamber containing a liquid, and rapidly moving the plunger towards the orifice. Mechanical actuators allow droplet generators to be used at high temperatures, but increase their complexity and restrict the frequency with which droplets can be produced.

Acoustic radiation pressure can be used to eject metal droplets from the free surface of a pool of molten metal by directing towards the surface bursts of energy from an acoustic source located at the bottom of the pool (U.S. Pat. No. 5,722,479 to Oeftering). Magneto-hydrodynamic (MHD) forces can also be used (U.S. Pat. No. 4,919,335 to Hobson et al.) to form a fine spray by passing an electric current through the molten metal and simultaneously applying a magnetic field perpendicular to the direction of the electric current. The resultant MHD force is used to force molten metal through a nozzle, forming droplets. Acoustic and MHD droplet generators are useful in producing sprays, but it is difficult to precisely control the size of droplets produced by these devices.

A stream of droplets can be produced by vibrating a liquid jet issuing from an orifice, inducing capillary instabilities that break the stream into uniform sized droplets. The excitation force can be applied to the jet using either an acoustic source (as in U.S. Pat. No. 5,445,666 to Peschka et al.) or a mechanical actuator (as in U.S. Pat. No. 5,810,988 to Smith Jr. et al.). This technique is useful in forming metal micro-spheres, but cannot be used to generate droplets on demand.

It would be very beneficial to provide a method and device for reproducibly producing individual droplets of a chosen size.

SUMMARY OF THE INVENTION

The present invention provides a method and device for producing individual or multiple droplets of a chosen size on demand.

In one aspect of the invention there is provided a method of producing droplets, comprising pressure pulsing a chamber with a gas, the chamber holding a material to be ejected as droplets, the chamber being pressurized for a sufficient time to build up a pressure sufficient to forcefully eject at least one droplet of said material through an outlet and thereafter relieving the pressure sufficiently rapidly to avoid ejection of further droplets from the chamber.

In another aspect of the invention there is provided an apparatus for generating and ejecting droplets therefrom, comprising:

a) a housing enclosing a chamber for holding a material to be ejected therefrom, a gas inlet and an outlet passageway communicating with said chamber;

b) pressurizing means connected to said gas inlet for pressure pulsing the chamber with a gas for forcefully ejecting at least one droplet through said outlet passageway; and c) pressure relief means for relieving pressure in said chamber sufficiently rapidly to avoid ejection of further droplets and to provide control of a number of droplets ejected from said chamber through said outlet passageway.

In this aspect of the invention the pressure relief means may include a vent in communication with the chamber for relieving pressure in the chamber, the vent having an effective size so that during application of a gas pulse the chamber is pressurized to a pressure sufficient to eject a droplet of material therefrom and thereafter the chamber is vented through the vent at a rate sufficient to prevent further discharge of droplets.

BRIEF DESCRIPTION OF THE DRAWINGS

The device for producing droplets constructed in accordance with the present invention will now be described, by way of example only, reference being had to the accompanying drawings, in which.

DETAILED DESCRIPTION OF THE INVENTION

The present invention provides a method of producing droplets, comprising pressurising a chamber with a gas, the chamber holding a material to be ejected as droplets, the chamber being pressurized for a sufficient time to build up a pressure sufficient to eject at least one droplet of the material through an outlet and thereafter relieving the pressure sufficiently rapidly to avoid ejection of further droplets from the chamber in order to allow control over the number of droplets ejected during processing.

Figure 1:
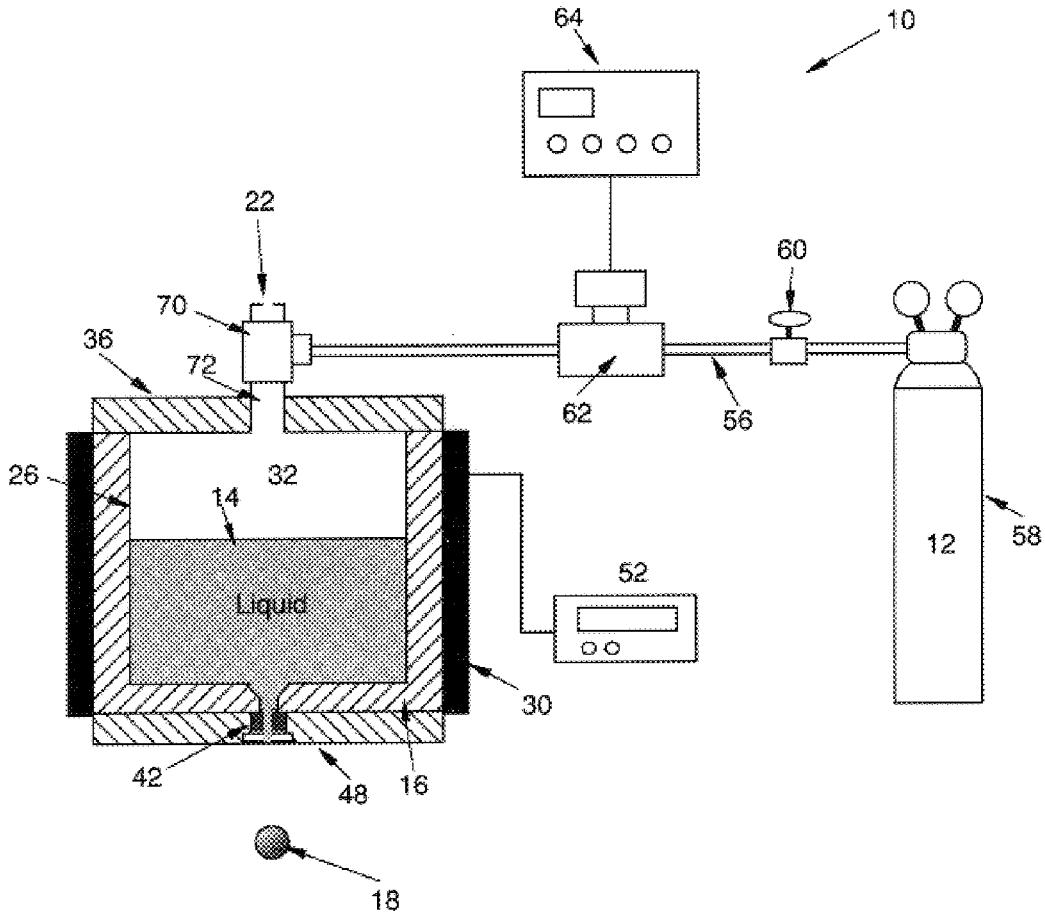
FIG. 1 is a schematic drawing showing the droplet generator assembly.

Referring to FIG. 1 an apparatus for generating droplets shown generally at 10 uses compressed gas 12 to deliver a pressure pulse to high temperature liquid 14 contained in a chamber 32 forming part of droplet generator 16. Briefly the pressure increase forces a small amount of liquid through a nozzle 42 in the wall of the chamber, thereby ejecting a liquid droplet 18. The gas in the chamber 32 is then vented through a small orifice 22, relieving the pressure and preventing any further liquid from being ejected. Each pressure pulse to the droplet generator 16 may therefore be used to produce a single droplet on demand.

Figure 2:
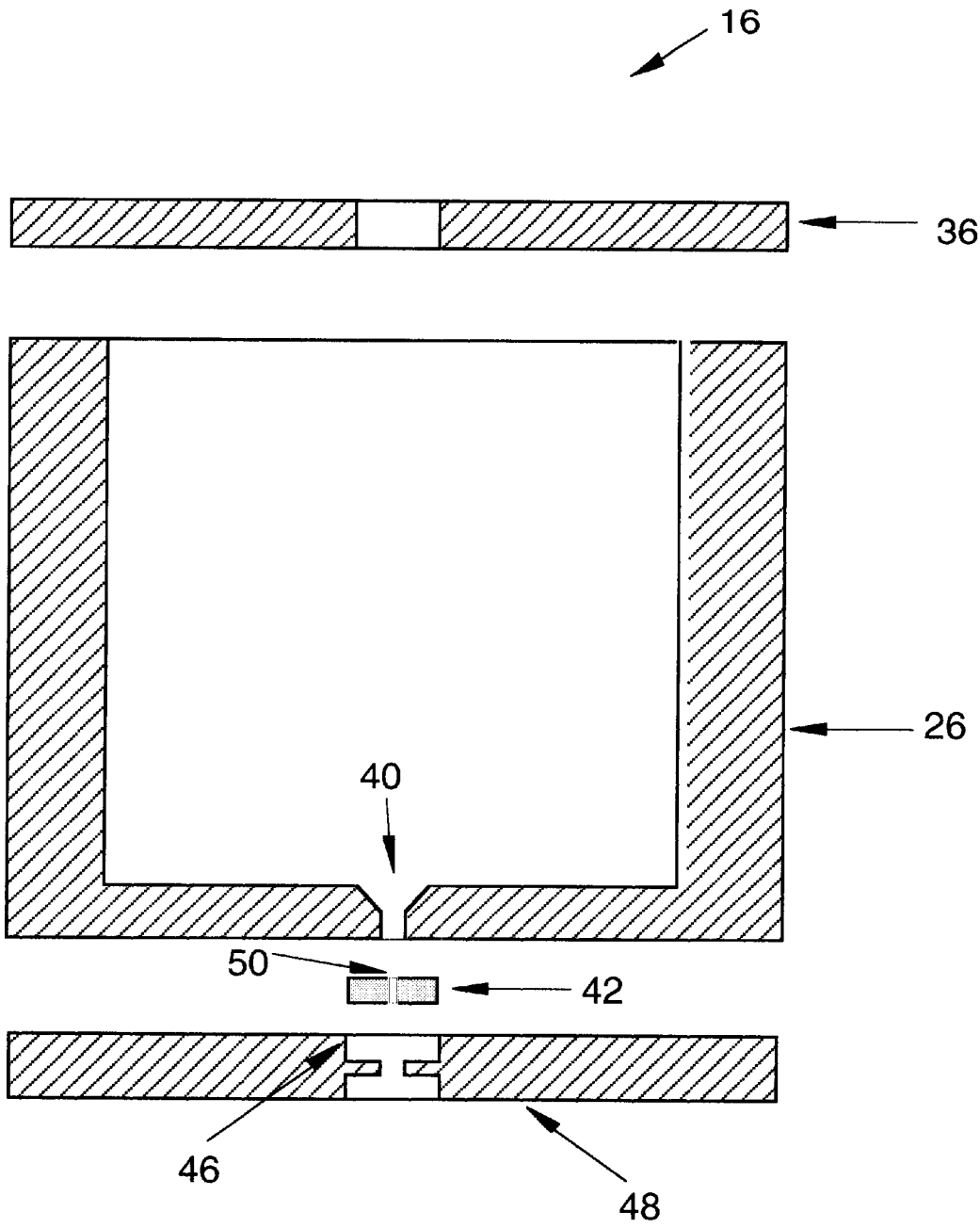
FIG. 2 is a diagram showing the components of the chamber in which molten metal is contained.

Referring to both FIG. 1 and FIG. 2, droplet generator chamber 16 includes a cylindrical stainless steel housing 26 heated by means of a band heater 30 (seen only in FIG. 1) wrapped around the housing. Housing 26 incloses a central chamber 32 to contain the liquid 14. Housing 26 includes a lid 36 placed over the top of the housing to seal chamber 32 thereby permitting it to be pressurised. Housing 26 includes an outlet passageway 40 drilled through the bottom of the housing through which the liquid droplets are ejected.

A commercially available synthetic sapphire nozzle 42 is placed at the exit of passageway 40 and is held fixed in a recess 46 located in a retainer plate 48 fastened to the bottom of the housing 26. Nozzles 42 are cylindrical, with an outer diameter of 0.0785" and a length of 0.034" in one embodiment. Liquid is forced through a hole 50 drilled in the centre of the nozzle: hole diameters ranging from 0.003" to 0.022" were used for testing purposes. In another embodiment nozzles were formed by directly drilling holes in the stainless steel plate with a laser instead of using removable sapphire nozzles.

Referring again to FIG. 1, the chamber 32 is filled with high temperature liquid 14 which is typically a molten metal. Housing 26 is heated by means of a band heater 30 to a temperature above the melting point of the liquid by a temperature controller 52. Chamber 32 is pressurised using nitrogen gas supplied through stainless steel tubing 56 from a compressed gas cylinder 58. Other inert gases may be used as long as they do not react with the molten metal being discharged. The pressure at which gas is supplied is controlled by a pressure regulator 60. Flow of nitrogen is controlled by a normally closed solenoid valve 62 that is opened for a period of time determined by an electronic timing circuit 64.

Droplets are formed by forcing liquid through the synthetic sapphire nozzle 42 sitting in retainer plate 48 at the bottom of housing 26. Nitrogen gas at a pressure of 20–40 psig is supplied to the cavity in which the liquid is contained. The cavity is rapidly pressurised by opening the solenoid valve 62 for 5–10 ms. This is sufficient to force a small droplet 18 through the sapphire nozzle 42. The pressure in the chamber 32 then drops as the nitrogen escapes through vent hole 22 drilled in a T-junction 70 in the coupling 72 connecting the gas line 56 to the droplet generator 16. The sudden decrease in pressure prevents any more metal droplets being ejected through the nozzle 42. The location and size of the vent hole 22 is important to the operation of the droplet generator. Hole 22 must be small enough to allow gas to accumulate in the chamber 32 and increase the pressure adequately to force a droplet out. However, hole 22 must also be large enough that the gas escapes quickly and relieves the pressure in the chamber 32 by the time a single droplet has escaped. If the pressure in chamber 32 does not drop with sufficient rapidity a jet of liquid issues out of the nozzle rather than a single droplet.

This design of the droplet generator 16 disclosed herein offers several advantages over previous designs. First, there is no inherent restriction on the operating temperature. Piezo-ceramic crystals fail at temperatures above 250° C., restricting their use to metals with melting points lower than this. Typically they have been used for depositing solder balls on printed circuit boards. The present system is extremely simple in that there are no moving parts in contact with the metal. This is advantageous in scaling up the system. Use of metal plungers greatly increases the complexity of the system, and makes it much more prone to clogging.

Droplet generator 16 is very advantageous because it may be used to produce a single droplet on demand. Most previously developed droplet generation systems work in a continuous mode and they cannot form just a single droplet when triggered. Another significant advantage of the present droplet generator is there is great control over droplet size. The droplet size is a function of the gas pressure, pulse duration, nozzle size, size and location of the relief vent. Some of these parameters, such as the pressure and duration of the gas pulse, can be altered during operation. It will be therefore possible to change the droplet size without dismantling the system and replacing the nozzle. Another significant advantage of the present system is repeatability of droplet size. Tests have shown that the droplet diameter produced is extremely repeatable. Other mechanically driven atomisation techniques used to produce droplets typically yield a very large range of particle sizes.

It will be understood that there are other ways of relieving the pressure in the chamber in addition to using the vent. For example, solenoid valves may be used wherein a gas outlet passageway includes the solenoid valve which is opened as required to relieve the pressure in the chamber after a droplet has been ejected. Pressure relief valves may also be connected to the chamber and designed to open at a pre-set pressure threshold thereby rapidly relieving pressure in the chamber. Whatever the mechanism for relieving the pressure it should be sufficiently rapid to prevent discharge of further droplets. The following is a non-limiting example of the invention disclosed herein.

EXAMPLE

Using the apparatus of FIG. 2, tin droplets were formed. Molten tin was held in the chamber at a temperature of 245°C., above the melting point of tin (which is 232° C.). A synthetic sapphire nozzle with an opening 0.003" in diameter was installed in the bottom of the chamber. Nitrogen gas was supplied to the chamber through ¼" stainless steel tubing. A ¼" Swagelok T-junction was used to connect the tubing to a threaded hole drilled in the lid of the chamber. The open branch of the T-junction was covered with a steel disk in the centre of which was drilled a 0.125" vent hole, which provided a vent for gas to escape from the chamber.

Figure 3:
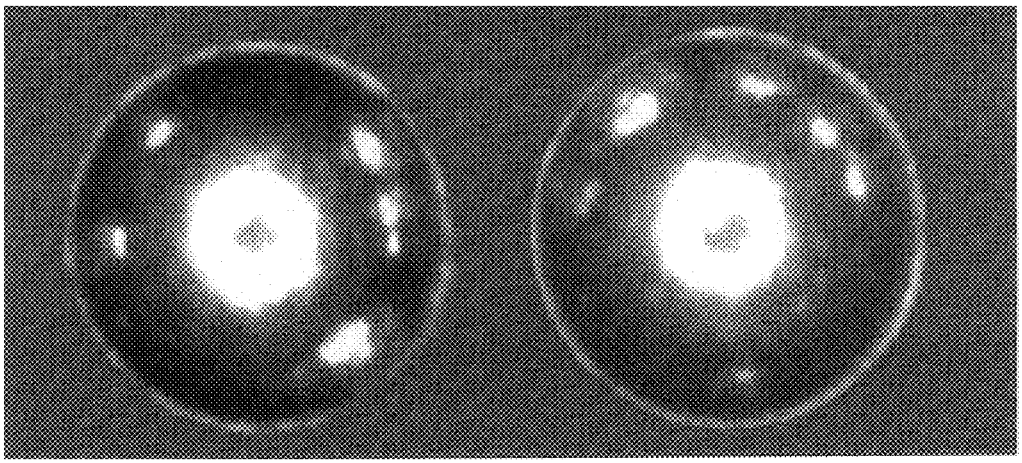
FIG. 3 shows two spherical tin droplets, 200 $\mu$m in diameter.
Figure 4:
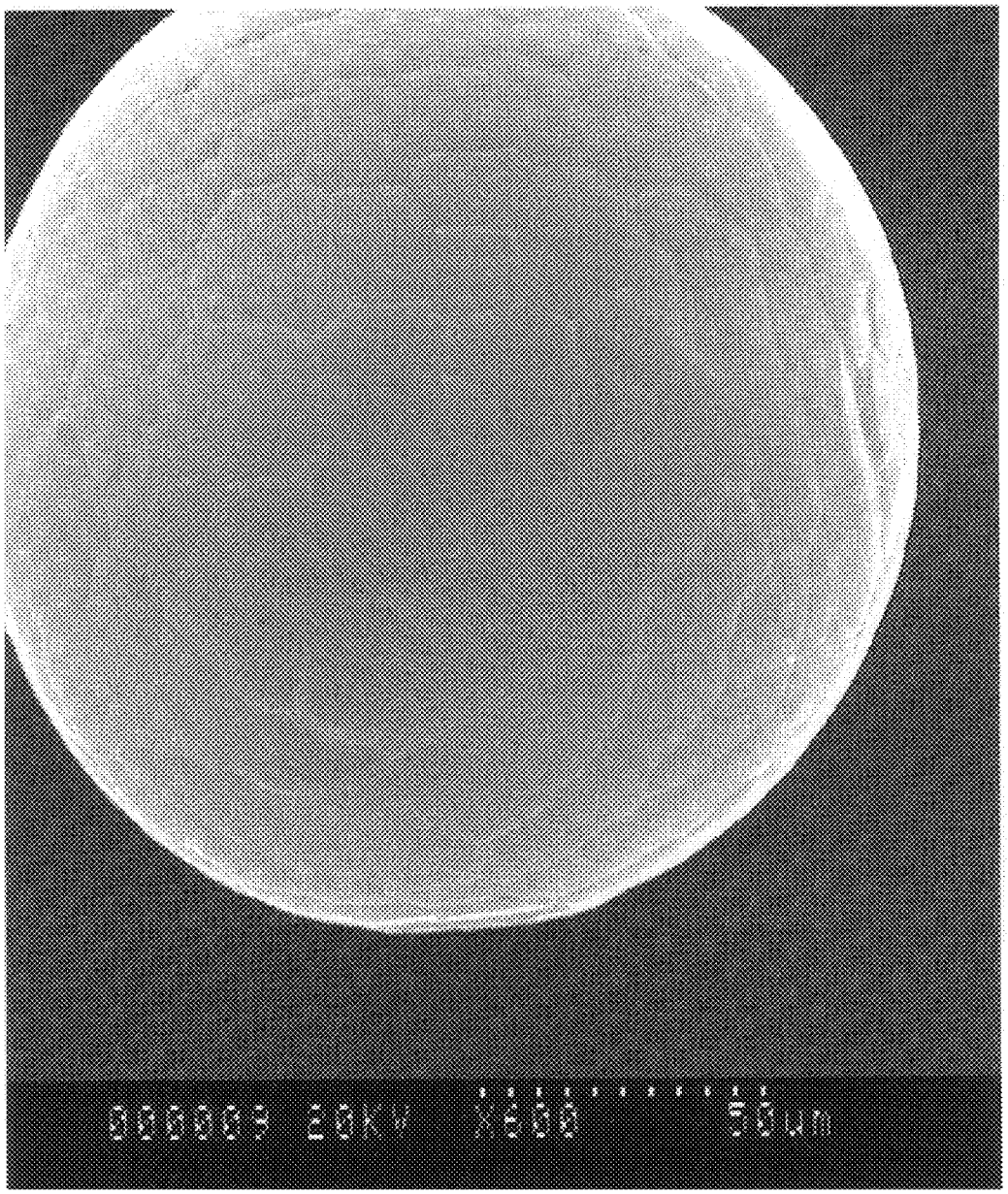
FIG. 4 shows an electron microscope image of a single tin particle.
Figure 5:
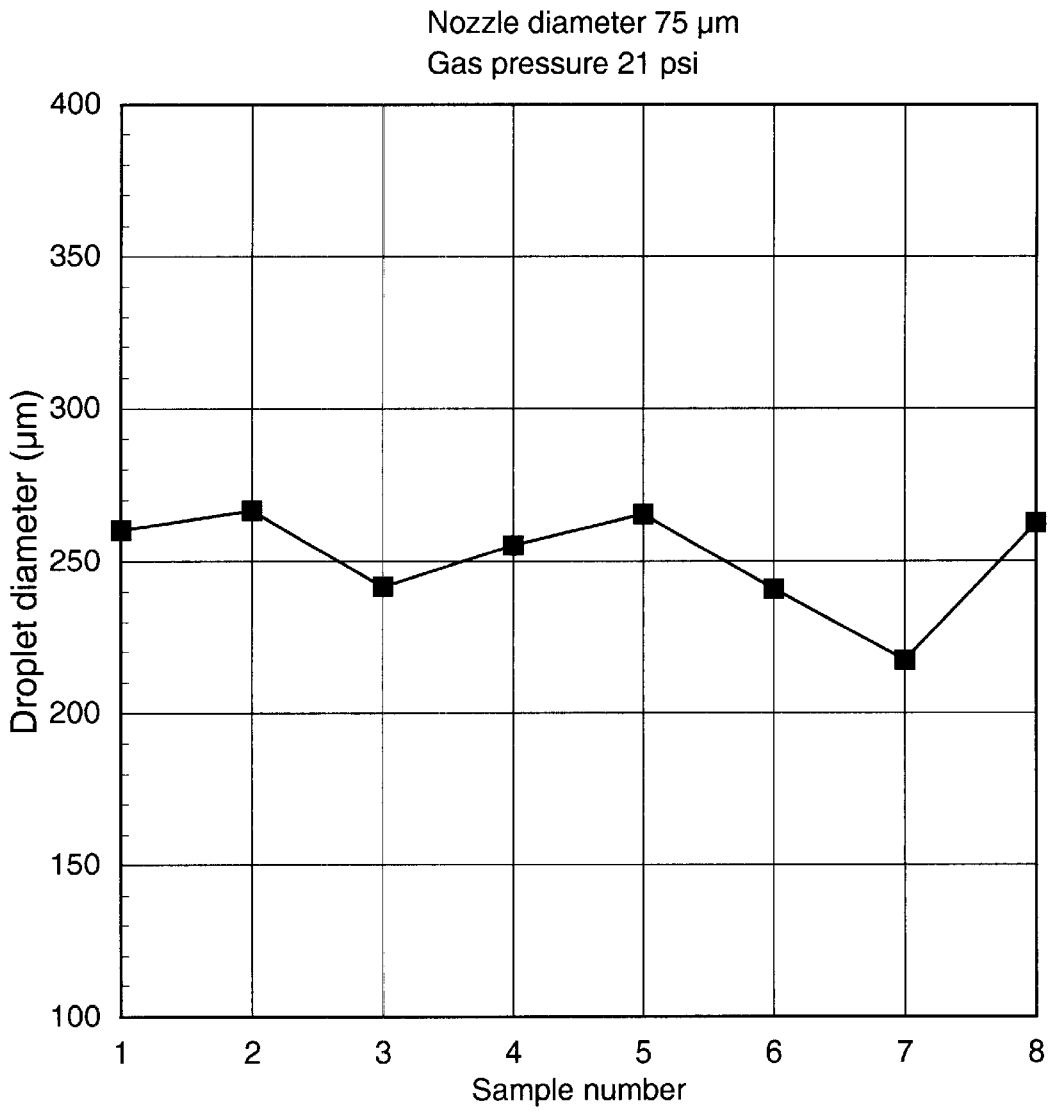
FIG. 5 shows the size distribution of droplets produced using a 0.003" diameter nozzle and a gas pressure of 21 psi.
Figure 6:
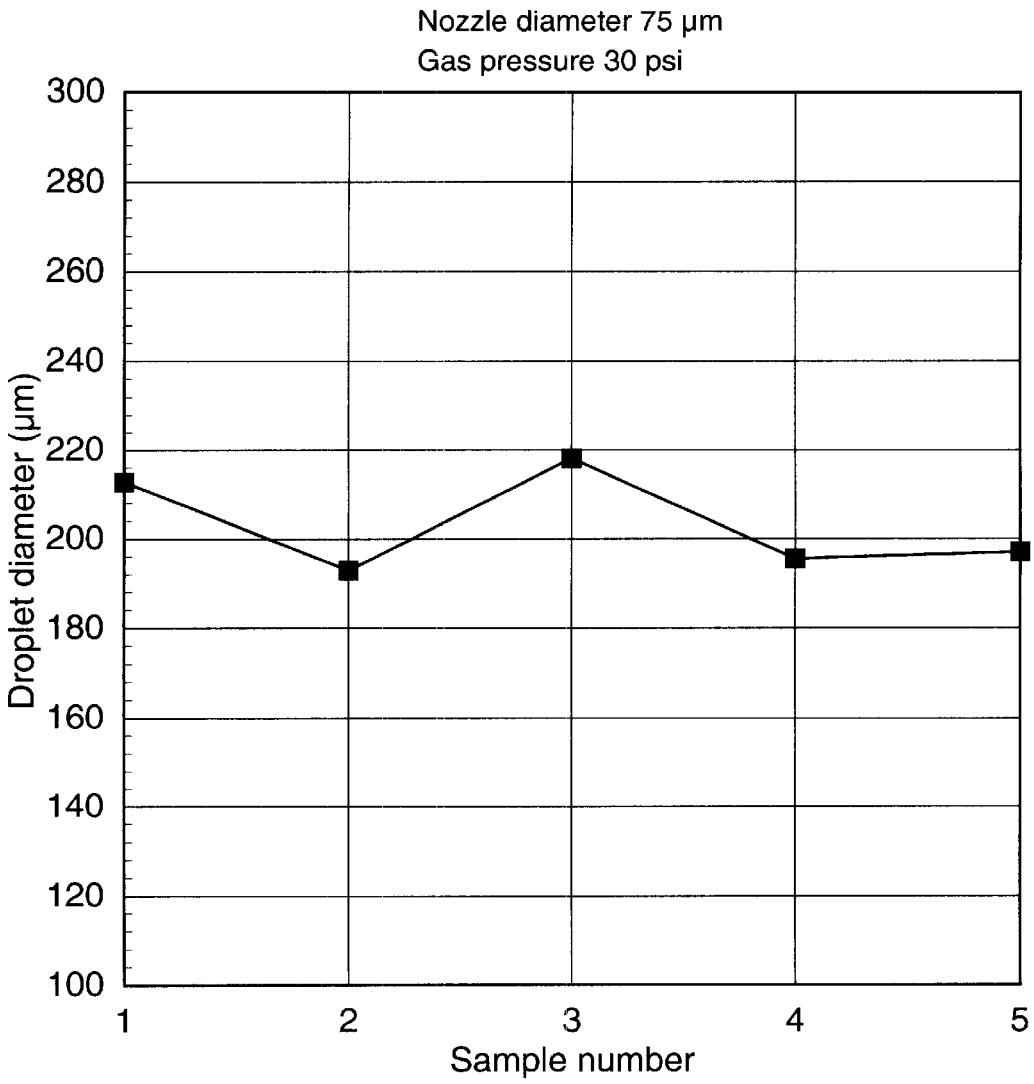
FIG. 6 shows the size distribution of droplets produced using a 0.003" diameter nozzle and a gas pressure of 30 psi.

A pulse of nitrogen gas was supplied to the chamber by opening the solenoid valve for 6 ms. Gas pressures were varied from 20 psig to 40 psig. Droplets ejected from the generator fell into a tube filled with nitrogen and solidified while in free-fall. Solidified tin particles were captured in a dish and examined under a microscope. They were found to be spherical and fairly uniform in diameter. FIG. 3 shows two tin particles, 200 $\mu$m in diameter, formed by the droplet generator. FIG. 4 shows a scanning electron microscope image of a single tin particle. FIG. 5 is a graph showing the size distribution of 8 spheres, formed using a gas pressure of 21 psig. The average droplet diameter was approximately 250 $\mu$m. FIG. 6 shows the size range when the gas pressure was increased to 30 psig; the droplet diameter is smaller, with an average value of approximately 200 $\mu$m.

Figure 7:
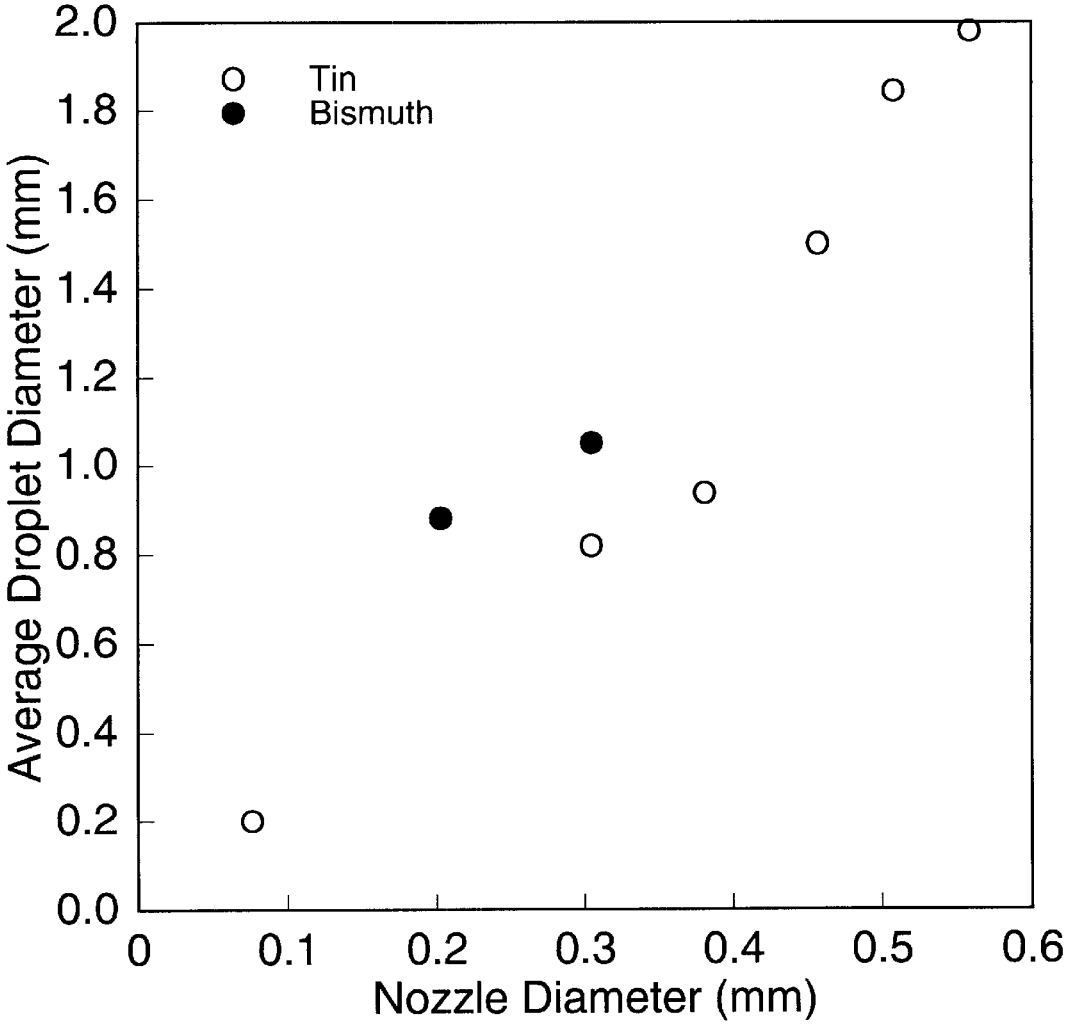
FIG. 7 shows the variation of droplet diameter with nozzle diameter for tin and bismuth.

Tests were done with a range of different nozzle sizes from 0.003" to 0.022" to produce particles of both tin and bismuth. FIG. 7 shows the relationship between the diameter of the droplet produced and the nozzle diameter. Droplet diameters increased linearly with nozzle diameter.

Figure 8:
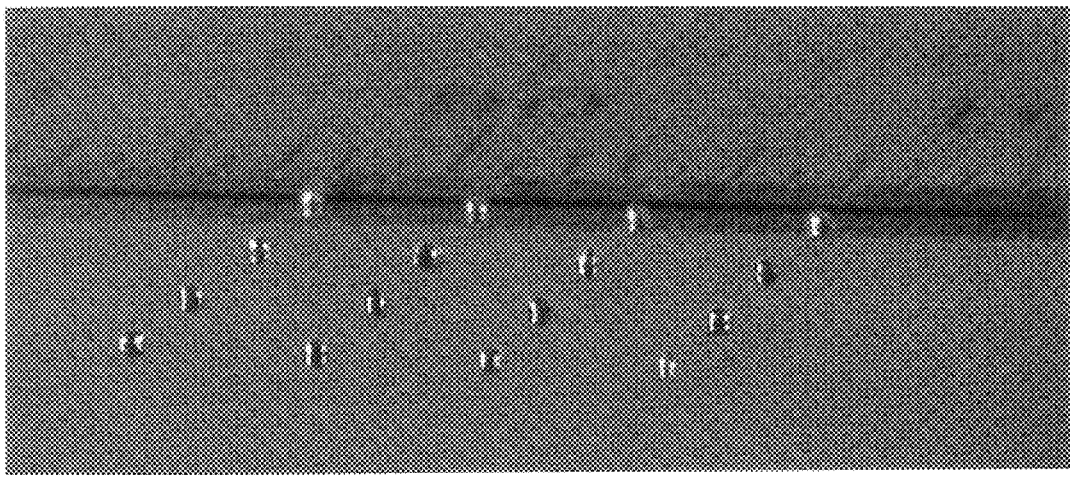
FIG. 8 shows 16 tin droplets, each 300 $\mu$m in diameter, deposited in a square grid spaced 3 mm apart on a stainless steel plate.

By moving a substrate under the droplet generator droplets could be deposited in a predetermined pattern. FIG. 8 shows 16 tin droplets, each 300 $\mu$m in diameter, deposited in a square grid spaced 3 mm apart. The substrate was a polished stainless steel plate mounted on computer-controlled positioning stages so that it could be moved under the droplet generator.

Figure 9:
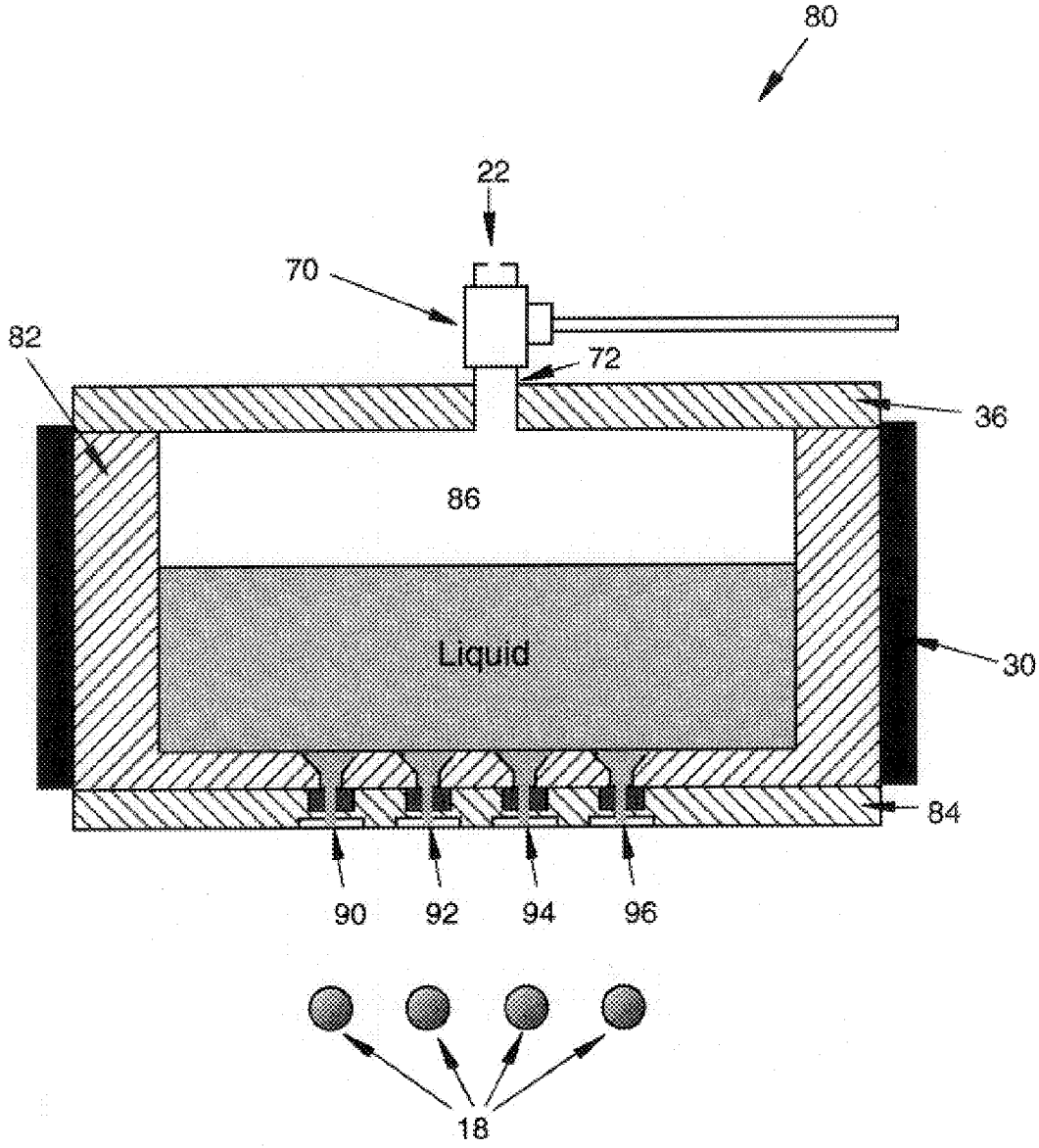
FIG. 9 is a cross sectional view of a droplet generator constructed with multiple nozzles.

Uniform sized particles comprising metal powder were produced by releasing droplets into an inert atmosphere and letting them freeze as they fall. Referring to FIG. 9, a droplet generator 80 includes a housing 82 defining an interior chamber 86 and multiple droplet discharge outlets 90, 92, 94 and 96 so that when chamber 86 is pressurised several uniformly sized droplets are ejected. Tests were done with 4 to 16 nozzles in a single droplet generator. Uniform sized powder particles have many applications, in plasma spraying it is useful to have a uniform powder size distribution because the trajectory and solidification rate of particles in a thermal spray depends on the size of the particles. Small particles may not have enough momentum to land on the substrate, or they freeze before impact and do not bond with the substrate. Therefore, having a very narrow size distribution permits much better control of the deposition process and reduces wastage of the powder. Similarly, when spray painting, dispensing adhesives, or spraying pesticide using conventional pressure atomiser, small droplets are prone to being blown away thereby missing the substrate also causing wastage and producing a major pollution hazard. The use of the present multiple droplet generator 80 permits production of mono-sized sprays thereby offering significant enhanced control over the spraying process.

However it will be understood that the different outlets 90 to 96 may be of different sizes relative to each other for applications requiring more than one size of particle.

Figure 10:
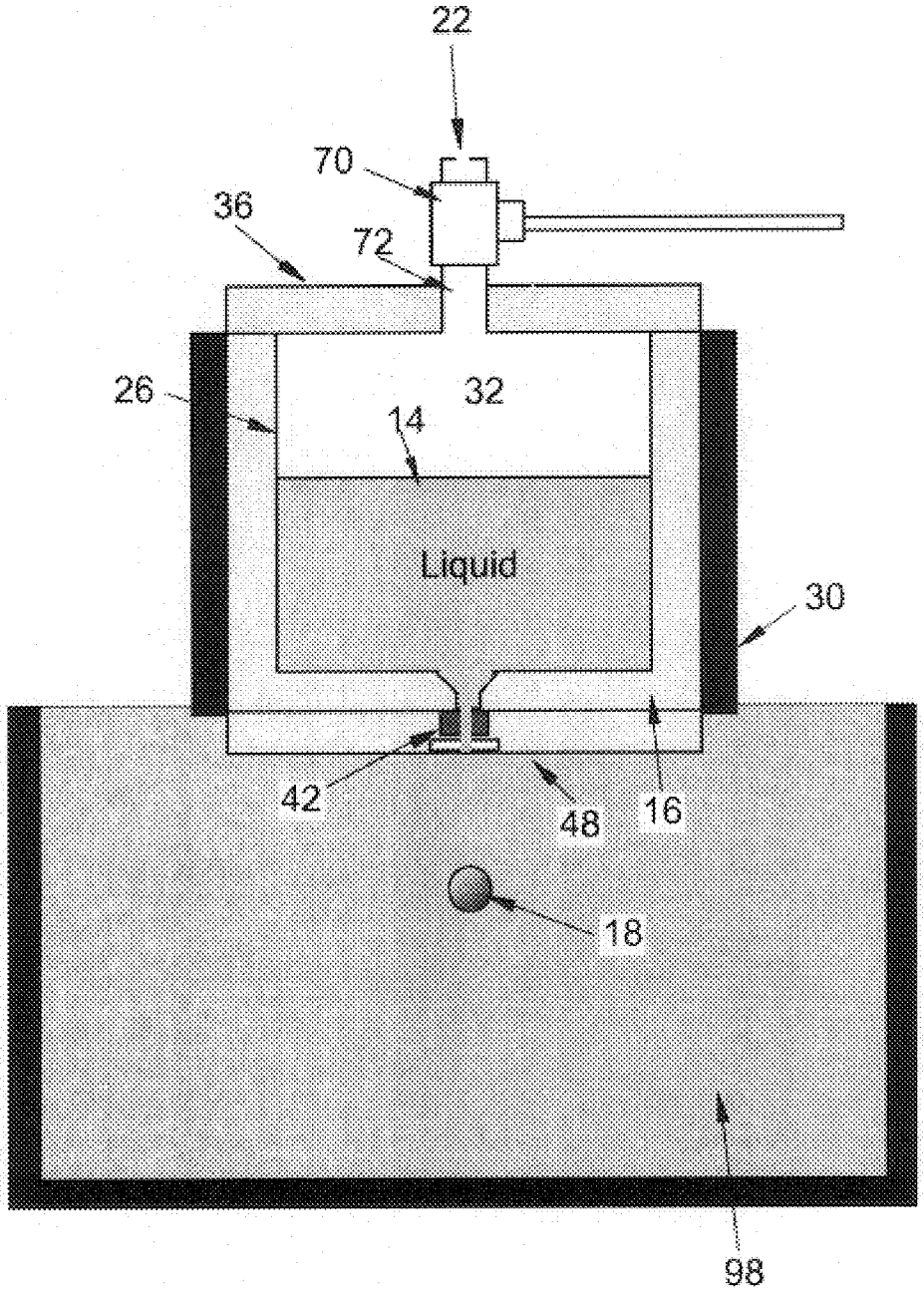
FIG. 10 is a cross sectional view of another embodiment of a droplet generator for rapid cooling of metal droplets.

Typically, in order to produce metal spheres from large (greater than 1 mm in diameter) droplets, the droplets have to fall through a 10–20 m height in air to solidify completely thus requiring large drop towers. Referring to FIG. 10, the present invention avoids this problem by immersing the end of the housing containing the nozzle 42 in a fluid bath comprising a fluid 98 having sufficient density and viscosity to slow and solidify the droplets 18 as they fall so that they freeze before hitting the bottom of the container. When oil was used as the fluid the droplets freeze within a distance of 5–10 cm of the nozzle after being ejected. In one example the container was filled with vegetable oil to a depth of 15 cm and tin and bismuth spheres were produced having diameters from 0.8 mm to 2.0 mm by letting molten metal droplets freeze as they fell in oil. This technique also has the advantage of eliminating any oxidation of the metal, so that oxide free spheres can be produced.

The apparatus and method disclosed herein is of significant utility for generating single droplets on demand in manufacturing techniques using droplet deposition such as in microelectronics manufacturing and processing. This invention also has utility in processes requiring spherical microspheres and uniform sized powders, and dispensing of precise quantities of materials such as adhesives and pharmaceuticals.

The foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. An apparatus for generating and ejecting droplets therefrom, comprising:

a) a housing enclosing a chamber for holding a material to be ejected therefrom, a gas inlet and an outlet passageway communicating with said chamber;

b) pressurizing means connected to said gas inlet for pressure pulsing said chamber with a gas for forcefully ejecting at least one droplet through said outlet passageway; and c) pressure relief means for relieving pressure in said chamber sufficiently rapidly to avoid ejection of further droplets from said chamber to provide control of a number of droplets ejected from said chamber through said outlet passageway.

2. The apparatus according to claim 1 wherein said pressure relief means includes a vent in communication with said chamber for relieving pressure in the chamber, the vent having an effective size so that during application of a gas pulse the chamber is pressurized to a pressure sufficient to eject a droplet of said material therefrom and thereafter the chamber is vented through the vent at a rate sufficient to prevent further discharge of droplets.

3. The apparatus according to claim 2 wherein said pressurizing means includes a timing circuit for controlling the length of time said gas pulses are applied to said chamber.

4. The apparatus according to claim 3 wherein said pressurizing means includes a gas handling system for applying gas pulses to said chamber.

5. The apparatus according to claim 2 wherein said housing includes a heater for heating a material in said chamber.

6. The apparatus according to claim 5 including a fluid bath for receiving droplets discharged from said outlet passageway for rapidly cooling said droplets.

7. The apparatus according to claim 6 wherein said fluid bath includes a container for holding said fluid, said housing being partially immersed in said container so droplets ejected from said outlet passageway contact said fluid, said fluid having an effective viscosity and density to solidify molten droplets ejected from said outlet passageway as said droplets fall a preselected distance in said fluid.

8. The apparatus according to claim 7 wherein said fluid is oil.

9. The apparatus according to claim 2 wherein said outlet passageway includes a sapphire nozzle, said sapphire nozzle having a passageway diameter in a preselected range.

10. The apparatus according to claim 2 wherein said outlet passageway is a first outlet passageway, said housing including a plurality of outlet passageways each in communication with said chamber.

11. The apparatus according to claim 2 wherein said outlet passageway has a diameter to produce droplets having a preselected diameter.

12. The apparatus according to claim 1 wherein said pressure relief means includes a vent in flow communication with said chamber and a solenoid valve for opening and closing said vent.

13. The apparatus according to claim 1 wherein said pressure relief means includes a pressure relief valve in flow communication with said chamber.

14. A method of producing droplets, comprising:

pressure pulsing a chamber using a gas, the chamber holding a material to be ejected as droplets, the chamber being pressurized for a length of time sufficient to build up a pressure sufficient to forcefully eject at least one droplet of said material through an outlet and thereafter relieving the pressure sufficiently rapidly to avoid ejection of further droplets from the chamber.

15. The method according to claim 14 wherein said pressure is relieved using a vent in communication with said chamber, and the vent being selected to have a size small enough such that when the chamber is pressurized by applying a pressure pulse using said gas for an effective period of time at least one droplet of said material is ejected through said outlet and large enough that after ejection of the droplet the pressure drops sufficiently rapid to avoid ejection of further droplets from the chamber.

16. The method according to claim 15 wherein said pressure pulse is applied using an inert gas supplied from a compressed gas source using a timing circuit for controlling the length of time said pressure pulse is applied.

17. The method according to claim 15 wherein the material being ejected is a molten metal.

18. The method according to claim 17 wherein said droplet is ejected into a fluid that is inert towards the material being ejected for rapidly cooling and solidifying said droplet.

19. The method according to claim 18 wherein said fluid has an effective viscosity and density to solidify molten droplets ejected from said outlet passageway as said droplets fall through a preselected distance in said fluid.

20. The method according to claim 15 wherein said outlet passageway has a diameter selected to produce droplets with a preselected diameter.

21. The method according to claim 14 including heating said material contained within said chamber.

22. The method according to claim 14 wherein said material to be ejected is a powder.

23. The method according to claim 14 wherein said outlet passageway has a diameter selected to produce droplets with a preselected diameter.

* * * * *